US011694634B2

(12) United States Patent
Kim

(10) Patent No.: US 11,694,634 B2
(45) Date of Patent: Jul. 4, 2023

(54) DISPLAY DEVICE AND METHOD FOR SELECTING GAMMA POWER

(71) Applicant: LG Display Co., Ltd., Seoul (KR)

(72) Inventor: Mincheul Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/504,256

(22) Filed: Oct. 18, 2021

(65) Prior Publication Data

US 2022/0148521 A1 May 12, 2022

(30) Foreign Application Priority Data

Nov. 9, 2020 (KR) ..... 10-2020-0148882

(51) Int. Cl.
*G09G 3/3291* (2016.01)

(52) U.S. Cl.
CPC ..... *G09G 3/3291* (2013.01); *G09G 2310/08* (2013.01); *G09G 2320/0285* (2013.01); *G09G 2320/0626* (2013.01); *G09G 2320/0673* (2013.01)

(58) Field of Classification Search
CPC .. G09G 3/3291; G09G 3/3233; G09G 3/3258; G09G 3/3225; G09G 3/3266; G09G 3/3275; G09G 2310/08; G09G 2320/0285; G09G 2320/0626; G09G 2320/0673; G09G 2320/0276; G09G 2320/0646; G09G 2320/0233; G09G 2330/028
See application file for complete search history.

(56) References Cited

U.S. PATENT DOCUMENTS

2014/0118409 A1* 5/2014 Jun ..... G09G 3/3233 345/690
2015/0138251 A1* 5/2015 Pyo ..... G09G 3/3233 345/82
2017/0186375 A1* 6/2017 Jung ..... G09G 3/3233
2019/0130835 A1* 5/2019 Ka ..... H01L 51/5206
2020/0335042 A1* 10/2020 Son ..... G09G 3/3291
2021/0201758 A1* 7/2021 Pyo ..... G09G 3/22

FOREIGN PATENT DOCUMENTS

KR 10-2020-0081859 A 7/2020
KR 10-2139693 B1 7/2020

* cited by examiner

*Primary Examiner* — David Tung
(74) *Attorney, Agent, or Firm* — Fenwick & West LLP

(57) ABSTRACT

Disclosed are a display apparatus and a method for selecting a gamma power in which when selecting a gamma set corresponding to each luminance in an organic light emitting (OLED) display apparatus, a low power voltage and an initial voltage corresponding thereto are selected, and are provided to a display panel, thereby optimizing a black voltage and a driving voltage. To this end, the display apparatus includes a data driver which sets the low voltage and the initialization voltage corresponding to each gamma set and stores the same into a lookup table. Therefore, the low power voltage and the initialization voltage are changed only by selecting the gamma set. The display apparatus is suitable for operating at a black voltage and a low gray voltage.

11 Claims, 5 Drawing Sheets

DISPLAY DEVICE AND METHOD FOR SELECTING GAMMA POWER

CROSS-REFERENCE TO RELATED APPLICATION

This application claims the benefit under 35 U.S.C. § 119(a) of Korean Patent Application No. 10-2020-0148882 filed on Nov. 9, 2020, in the Korean Intellectual Property Office, the entirety of disclosure of which is incorporated herein by reference for all purposes.

BACKGROUND

Technical Field

The present disclosure relates to a display apparatus and a method for selecting gamma power in which when selecting a gamma set corresponding to each luminance in an organic light emitting (OLED) display apparatus, a low power voltage and an initial voltage corresponding thereto are selected, and are provided to a display panel, thereby optimizing a black voltage and a driving voltage.

Description of Related Art

In general, in an organic light-emitting display apparatus, an organic light emitting diode (OLED) of a display panel has high luminance and low operation voltage characteristics. The organic light-emitting display apparatus is self-luminous. Therefore, the organic light-emitting display apparatus has a high contrast ratio and is implemented as an ultra-thin display. Further, a response time of the OLED is several microseconds (μs), and thus the display apparatus easily implements a moving image. The display apparatus has no limitation in a viewing angle and has a stable characteristic even at low temperatures.

In the organic light emitting diode (OLED), an anode is connected to a drain electrode of a driving thin-film transistor D-TFT, and a cathode is grounded (VSS). An organic light-emitting layer is formed between the cathode and the anode.

In the above-described organic light-emitting display apparatus, when a data voltage Vd is applied to a gate electrode of the driving thin-film transistor, a current between a drain and a source flows according to a voltage Vgs between a gate and the source and is supplied to the organic light emitting diode. This organic light-emitting display apparatus controls a gray level of the image by controlling an amount of current flowing through the organic light emitting diode through the driving thin-film transistor.

SUMMARY

The above-described organic light-emitting display apparatus controls brightness of the self-emissive OLED by controlling an amount of current applied to the OLED using a TFT element mounted on each pixel. In this connection, a dimming scheme, in which as luminance decreases a light-emitting time duration linearly decreases, is used.

In this dimming scheme, the organic light-emitting display apparatus receives luminance data from an external component and then selects one gamma set corresponding to the luminance data from among a plurality of gamma sets, and provides dimming data corresponding to the selected gamma set to the OLED element.

In one example, a driver IC for a mobile OLED basically has a set for selecting a gamma voltage. The number of the sets may vary based on a type of the driver IC. However, usually, 6 to 8 sets may be allocated to the driver IC. Actually, only 4 to 6 sets are used.

A gamma voltage value may vary for each set. However, all sets actually employ the same low voltage ELVSS. In other words, an optimal driving voltage may vary for each sample, and optimal low voltage ELVSS and initialization voltage Vini2 may vary for each set. However, only representative values thereof are applied collectively.

Therefore, a stain or leakage of black voltage may occur when the display apparatus operates at a black voltage and a low gray voltage.

Therefore, in order to solve the above-described problem, a display apparatus according to the present disclosure includes a data driver which sets a low voltage ELVSS and an initialization voltage Vini2 corresponding to each gamma set and stores the same into a lookup table.

Further, a display apparatus according to an embodiment of the present disclosure includes a data driver which selects a gamma set according to luminance data of image data, and selects a low voltage ELVSS and an initialization voltage Vini2 corresponding to the selected gamma set based on the lookup table, and provides the selected low voltage ELVSS and initialization voltage Vini2 to a display panel.

Further, according to an embodiment of the present disclosure, a method for selection of a gamma power of a display apparatus selects a gamma set according to luminance data of image data received from an external component, and selects a low voltage ELVSS and an initialization voltage Vini2 corresponding to the selected gamma set based on the lookup table, and provides the selected low voltage ELVSS and initialization voltage Vini2 to a display panel.

Purposes in accordance with the present disclosure are not limited to the above-mentioned purpose. Other purposes and advantages in accordance with the present disclosure as not mentioned above may be understood from following descriptions and more clearly understood from embodiments in accordance with the present disclosure. Further, it will be readily appreciated that the purposes and advantages in accordance with the present disclosure may be realized by features and combinations thereof as disclosed in the claims.

A display apparatus for gamma power selection according to an embodiment of the present disclosure may be provided. The display apparatus for gamma power selection has a display panel having a plurality of pixels, each pixel including an organic light-emitting diode at each of intersections between a plurality of gate lines and a plurality of data lines. The display apparatus applies a scan signal to the plurality of gate lines through a scan driver, and a data signal to the plurality of data lines through a data driver. The display apparatus has a power part that provides a high power voltage ELVDD, a low power voltage ELVSS and an initialization voltage Vini2 to each pixel, and has a luminance controller that applies one gamma set selected from among a plurality of gamma sets, each including a plurality of gamma data, to the data driver, and applies dimming data corresponding to the selected gamma set to a light-emission controller. The data driver includes a lookup table in which stores respective on low power voltage data and one initialization voltage data in correspondence with one gamma set for the plurality of gamma sets. When the data driver receives one gamma set selected from the luminance controller, the data driver selects the low power voltage data and the initialization voltage data corresponding to the received one gamma set based on the lookup table. And the data driver provides the selected the low power voltage data and the initialization voltage data to the power part. Therefore, the power part provides a low power voltage ELVSS and an initialization voltage Vini2 corresponding to the low power voltage data and initialization voltage data provided from the data driver to the display panel.

Further, a method for selecting gamma power of a display apparatus according to an embodiment of the present disclosure may be provided. In the method for selecting the gamma power, when a luminance controller of the display apparatus receives luminance data to be output to a display panel from an external component, a gamma set selector selects a gamma set corresponding to the luminance data from among a plurality of gamma sets, each including a plurality of gamma data. Then, the luminance controller outputs the selected gamma set to the data driver and fetches dimming data corresponding to the selected gamma set, and outputs the dimming data to a light-emission controller. Accordingly, the data driver acquires a low power voltage data and an initialization voltage data corresponding to the selected gamma set from the lookup table, and provides the obtained low power voltage data and initialization voltage data to the power part. Therefore, the power part provides a low power voltage ELVSS and an initialization voltage Vini2 corresponding to the low power voltage data and initialization voltage data provided from the data driver to the display panel.

According to an embodiment of the present disclosure, one low voltage ELVSS and one initialization voltage Vini2 are allocated per one gamma set in an optimized manner for each panel characteristic such that the low voltage ELVSS and the initialization voltage Vini2 optimized for each gamma set may be provided.

Therefore, according to an embodiment of the present disclosure, the low voltage ELVSS and the initialization voltage Vini2 may be changed by selecting the gamma set.

Further, an embodiment of the present disclosure may implement a display apparatus suitable for operating at the black voltage and the low gray level rather than setting and using the same low voltage ELVSS and the same initialization voltage Vini2 for all of the gamma sets.

Moreover, according to an embodiment of the present disclosure, when changing the luminance of the organic light-emitting display apparatus, a gamma set and dimming data corresponding to each luminance may be supplied. Thus, precise dimming operation may be realized. As a result, the quality of the image output by the organic light-emitting display apparatus may be improved.

Effects of the present disclosure are not limited to the above-mentioned effects, and other effects as not mentioned will be clearly understood by those skilled in the art from following descriptions.

DETAILED DESCRIPTIONS

Figure 1:
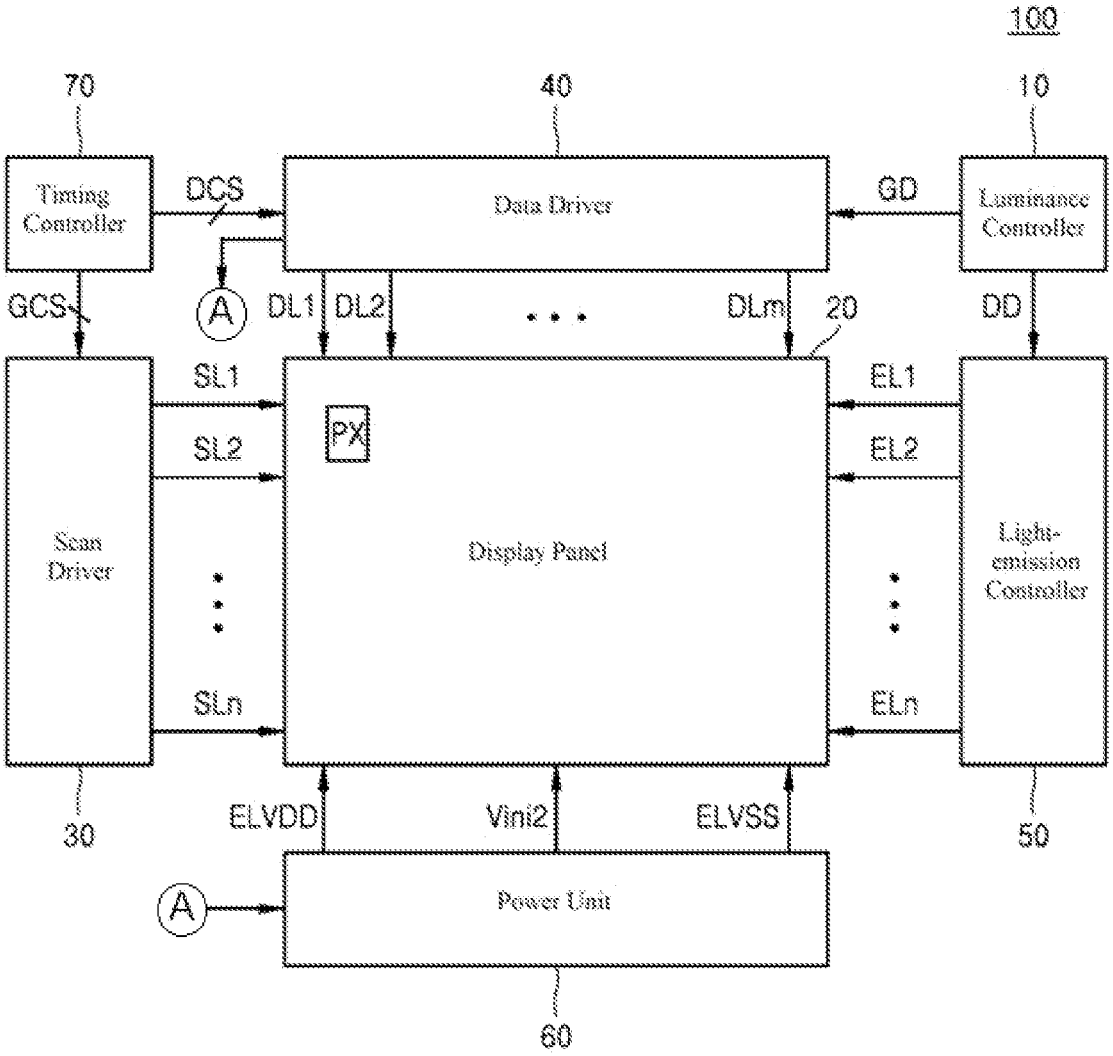
FIG. 1 illustrates an overall configuration of a display apparatus for selection of a gamma voltage according to an embodiment of the present disclosure.

Advantages and features will become apparent with reference to embodiments described later in detail together with the accompanying drawings. However, the present disclosure is not limited to embodiments as disclosed below, but may be implemented in various different forms. Thus, these embodiments are set forth only to make the present disclosure complete, and to completely inform the scope of the disclosure to those of ordinary skill in the technical field to which the present disclosure belongs, and the present disclosure is only defined by the scope of the claims.

A shape, a size, a ratio, an angle, a number, etc. disclosed in the drawings for describing an embodiments of the present disclosure are exemplary, and the present disclosure is not limited thereto. The same reference numerals refer to the same elements herein. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list. In interpretation of numerical values, an error or tolerance therein may occur even when there is no explicit description thereof.

In addition, it will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

In descriptions of temporal relationships, for example, temporal precedent relationships between two events such as "after", "subsequent to", "before", etc., another event may occur therebetween unless "directly after", "directly subsequent" or "directly before" is not indicated.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The features of the various embodiments of the present disclosure may be partially or entirely combined with each other, and may be technically associated with each other or operate with each other. The embodiments may be implemented independently of each other and may be implemented together in an association relationship.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a display apparatus for selection of a gamma voltage according to some embodiments of the present disclosure will be described.

FIG. 1 illustrates an overall configuration of a display apparatus for selection of a gamma voltage according to an embodiment of the present disclosure.

Referring to FIG. 1, a display apparatus 100 for selection of a gamma voltage according to an embodiment of the present disclosure includes a luminance controller 10, a display panel 20 in which a number of pixels are defined, a scan driver 30, a data driver 40, a light-emission controller 50, a power part 60 connected to the display panel 20, and a timing controller 70.

The luminance controller 10 provides one gamma set selected from among a plurality of gamma sets, each including a plurality of gamma data, to the data driver 40, and provides dimming data corresponding to the selected gamma set to the light-emission controller 50.

The display panel 20 may include a plurality of pixels PX. In this connection, each of the pixels PX may have an organic light-emitting diode.

In the display panel 20, a plurality of gate lines GL and a plurality of data lines DL intersect each other, and each pixel PX is defined at each intersection therebetween.

That is, in the display panel 20, the plurality of gate lines GL and the plurality of data lines DL are formed on an organic substrate or a plastic substrate and intersect with each other. Each of the pixels PX corresponding to red R, green G, and blue B colors is defined at each of the intersections between the gate lines GL and the data lines DL.

The scan and data lines SL and DL of the display panel 20 may be respectively connected to the scan driver 30 and the data driver 40 formed outside of the display panel 20. Further, in the display panel 20, power voltage supply lines ELVDD, Vini2, and ELVSS extending in a direction parallel to the data line DL are connected to each pixel PX.

Further, although not shown, each pixel PX includes at least one organic light emitting diode, a capacitor, a switching thin-film transistor, and a driving thin-film transistor. In this connection, the organic light emitting diode may be composed of a first electrode (hole injection electrode), an organic compound layer, and a second electrode (electron injection electrode).

The organic compound layer may further include various organic layers for efficiently transmitting hole or electron carriers to the light-emitting layer, in addition to the light-emitting layer that emits light. The various organic layers may include a hole injection layer and a hole transport layer positioned between the first electrode and the light-emitting layer, and an electron injection layer and an electron transport layer positioned between the second electrode and the light-emitting layer.

Further, the switching and driving thin-film transistors are connected to the scan line SL and a control signal supply line CL and the data line DL. The switching thin-film transistors are turned on according to a gate voltage input to the scan line SL. At the same time, a data voltage input to the data line DL is transmitted to the driving thin-film transistor. The capacitor is connected and disposed between the thin-film transistor and the power supply line, and is charged with the data voltage transmitted from the thin-film transistor and maintained for one frame.

Moreover, the driving thin-film transistor is connected to the power supply line VL and the capacitor, and provides a drain current corresponding to a voltage across a gate and the source to the organic light emitting diode. Accordingly, the organic light emitting diode emits light using the drain current. In this connection, the driving thin-film transistor includes a gate electrode, source electrode and a drain electrode. An anode of the organic light emitting diode is connected to one electrode of the driving thin-film transistor.

The scan driver 30 applies a scan signal to the plurality of scan lines SL. That is, the scan driver 30 sequentially applies a gate voltage to each pixel PX on a single horizontal line basis, in response to the gate control signal GCS. The scan driver 30 may be implemented as a shift register having a plurality of stages sequentially outputting a high-level gate voltage every one horizontal period.

The data driver 40 applies a data signal to the plurality of data lines DL. That is, the data driver 40 receives an image signal in a digital waveform applied from the timing controller 70 and converts the image signal into an analog data voltage having a gray level value that may be processed by the pixel PX. Further, in response to the data control signal DCS input thereto, the data driver 40 supplies the data voltage to each pixel PX through the data line DL.

In this connection, the data driver 40 converts the image signal into the data voltage using a number of reference voltages supplied from a reference voltage supply (not shown).

The light emission controller 50 applies a light-emission control signal to a plurality of pixels.

The power part 60 provides a high power voltage ELVDD, a low power voltage ELVSS and an initialization voltage Vini2 to each pixel.

The timing controller 70 controls the scan driver 30 and the data driver 40. That is, the timing controller 70 receives the image signal, and timing signals such as a clock signal, and vertical and horizontal synchronization signals as externally applied, and generates the gate control signal GCS and a data control signal DCS.

In this connection, the horizontal synchronization signal represents a time duration required to display one line of a screen. The vertical synchronization signal represents a time duration required to display a screen of one frame. Further, the clock signal refers to a reference for generating control signals for the gate and the drivers.

In one example, although not shown, the timing controller 70 is connected to an external system through a predefined interface and receives the image-related signals and the timing signals output therefrom at high speed without noise. The interface may employ an LVDS (Low Voltage Differential Signal) scheme or a TTL (Transistor-Transistor Logic) interface scheme.

Further, the timing controller 70 according to an embodiment of the present disclosure may incorporate therein a microchip (not shown) equipped with a compensation model that generates a compensation value for the data voltage according to a current deviation of each pixel. Thus, the voltage compensation value may be applied to the image signal to be provided to the data driver 40 so that the data voltage to be supplied from the data driver 40 is subjected to compensation based on the voltage compensation value.

In this connection, the microchip (not shown) may have a compensation model created by learning, for example, a temperature, a weighted time, average brightness, applied data signal, and an initial data signal for each pixel using a deep learning scheme. In this connection, the data signal means the data voltage. Moreover, the compensation model may be created by a computer simulator that learns the temperature, the weighted time, the average brightness, the applied data signal, and the initial data signal for each pixel using the deep learning scheme.

Therefore, the microchip may input the data signal to the compensation model and thus generate a compensated data signal. The timing controller 70 applies the generated compensated data signal to the data driver 40.

Figure 2:
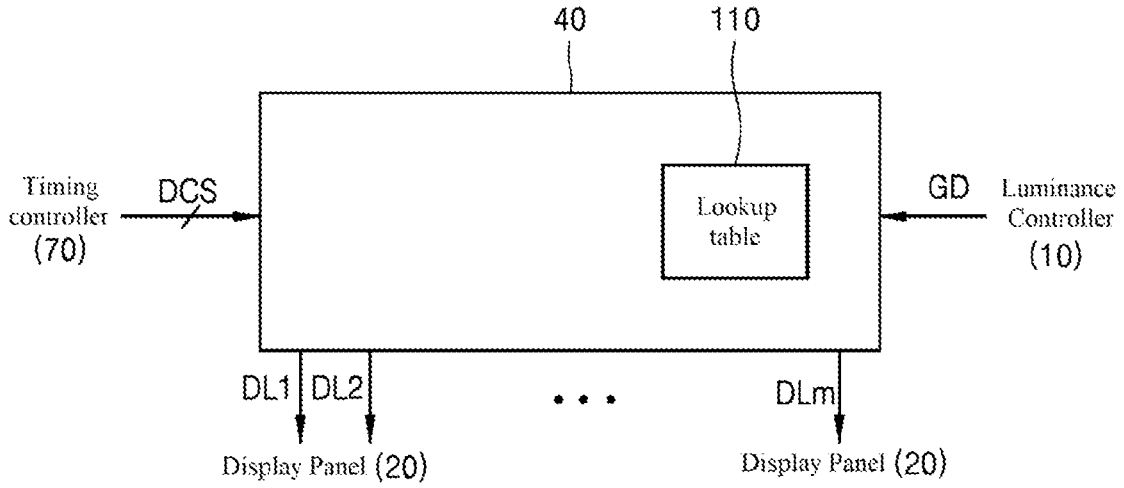
FIG. 2 illustrates an internal structure of a data driver according to an embodiment of the present disclosure.
Figure 3:
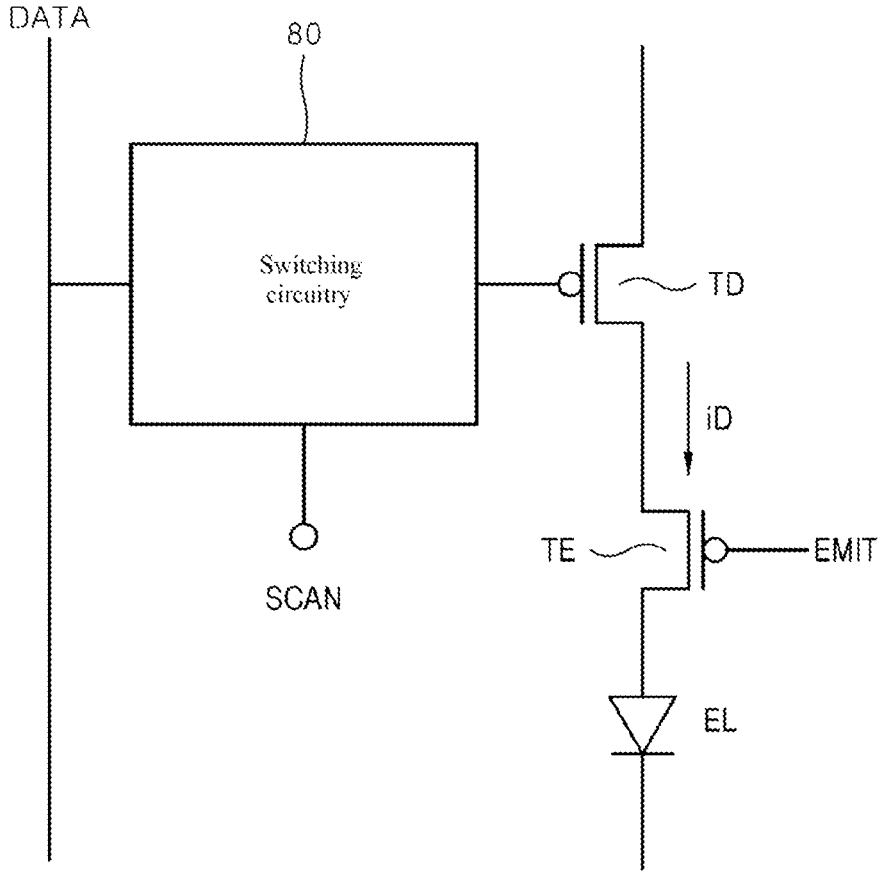
FIG. 3 illustrates a pixel circuit of a display apparatus for selection of a gamma voltage according to an embodiment of the present disclosure.

FIG. 2 illustrates an internal structure of the data driver according to an embodiment of the present disclosure. FIG. 3 illustrates a pixel circuit of a display apparatus for selection of a gamma voltage according to an embodiment of the present disclosure.

Referring to FIG. 2, the data driver 40 according to an embodiment of the present disclosure includes a lookup table 110 in which stores respective one low power voltage data and one initialization voltage data correspondences with one gamma set the plurality of gamma sets.

Therefore, when the data driver 40 receives a selected one gamma set from the luminance controller 10, the data driver 40 may select the low power voltage data and the initialization voltage data corresponding to the selected one gamma set, based on the lookup table 110, and provide the low power voltage data and the initialization voltage data to the power part 60. The power part 60 provides a low power voltage ELVSS and an initialization voltage Vini2 corresponding to the low power voltage data and initialization voltage data provided from the data driver 40 to the display panel 20.

Referring to FIG. 3, each pixel PX may include a switching circuitry 80, a driving transistor TD, a light-emission control transistor TE, and an organic light-emitting diode EL.

The switching circuitry 80 may transmit the data signal DATA supplied from the data line to the driving transistor TD in response to the scan signal SCAN supplied from the scan line.

The switching circuitry 80 may be configured to have each of various structures that transmit the data signal DATA to the driving transistor TD. For example, the switching circuitry 80 may include a storage capacitor and a switching transistor connected to the data line and the scan line.

The driving transistor TD may adjust a current iD flowing in the organic light-emitting diode EL based on the data signal DATA transmitted from the switching circuitry 80. In this connection, the luminance of the organic light-emitting diode EL may be adjusted based on a magnitude of the current iD. The light-emission control transistor TE is connected to the driving transistor TD and the organic light-emitting diode EL to control the light emission of the organic light-emitting diode EL.

Specifically, when the light-emission control transistor TE is turned on in response to a light-emission control signal EMIT supplied from a light-emission control line, the current flowing in the driving transistor TD is transferred to the organic light-emitting diode EL to emit light. When the light-emission control transistor TE is turned off, the current flowing in the driving transistor TD is not transmitted to the organic light-emitting diode EL, so that the organic light-emitting diode EL may not emit light.

In this way, the luminance of the organic light-emitting display apparatus may be determined based on the magnitude of the current iD supplied from the driving transistor TD and a timing when the light-emitting transistor TE is turned on.

Figure 4:
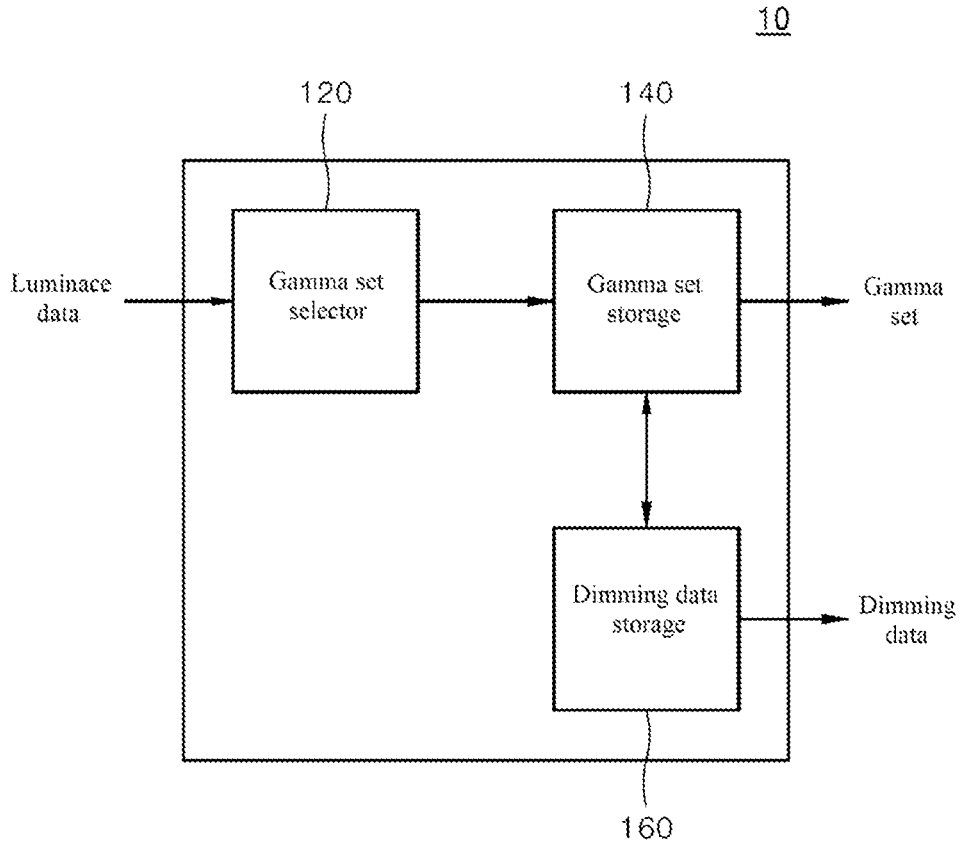
FIG. 4 is a block diagram showing a luminance controller according to an embodiment of the present disclosure.
Figure 5:
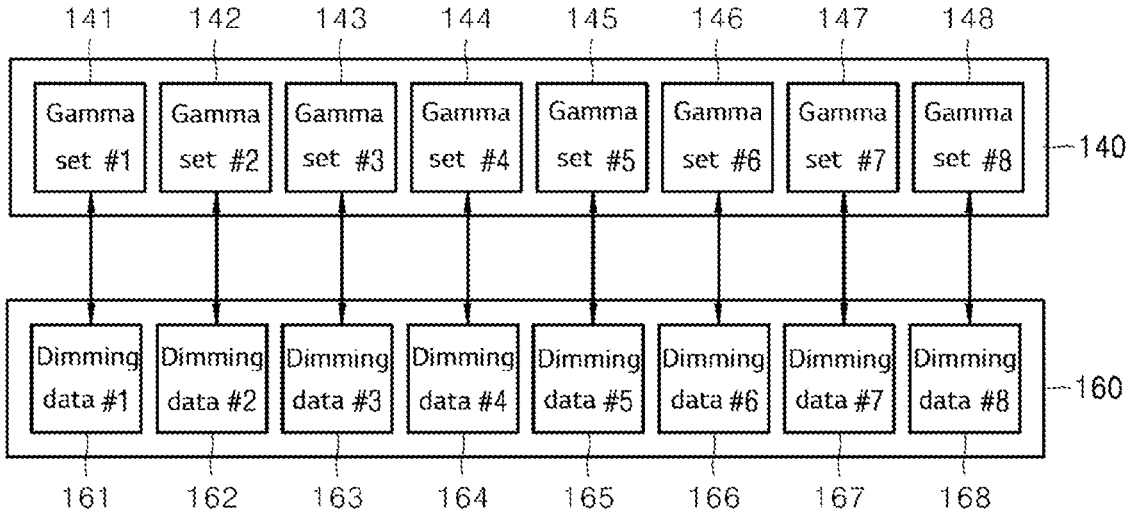
FIG. 5 is a block diagram showing a gamma set storage and a dimming data storage included in the luminance controller of FIG. 4.

FIG. 4 is a block diagram showing a luminance controller according to an embodiment of the present disclosure. FIG. 5 is a block diagram showing the gamma set storage and dimming data storage included in the luminance controller of FIG. 4.

Referring to FIG. 4, the luminance controller 10 may include a gamma set selector 120, a gamma set storage 140, and a dimming data storage 160.

The gamma set selector 120 may receive the luminance data to be output to the display panel from an external system.

In this connection, the externally input luminance data may represent a maximum luminance to be realized by the organic light-emitting display apparatus, and thus may be within a range that may be realized by the organic light-emitting display apparatus. For example, for an organic light-emitting display apparatus capable of outputting up to 300 nit, the luminance data may be selected from a range of 0 to 300 nit.

The gamma set selector 120 may select a gamma set whose maximum luminance matches the luminance data from the lookup table in which the plurality of gamma sets are stored.

Referring to FIG. 4, the gamma set storage 140 may include, for example, a first gamma set 141 to an eighth gamma set 148.

Each of the gamma sets 141, 142, 143, 144, 145, 146, 147, and 148 may store therein gamma data corresponding to each gray level. For example, for an organic light-emitting display apparatus operating in an 8-bit manner, each of the gamma sets 141, 142, 143, 144, 145, 146, 147, and 148 may store therein gamma data corresponding to 0 to 225 gray levels.

The gamma set 141, 142, 143, 144, 145, 146, 147, or 148 selected by the gamma set selector 120 together with corresponding dimming data 161, 162, 163, 164, 165, 166, 167, or 168 stored in the dimming data storage 160 may be transmitted to each pixel through the data driver 40 and the light-emission controller 50.

That is, a luminance level at which the organic light-emitting display apparatus outputs an image may be determined based on the gamma set 141, 142, 143, 144, 145, 146, 147, or 148 and the corresponding dimming data 161, 162, 163, 164, 165, 166, 167, or 168.

The gamma data stored in each of the gamma sets 141, 142, 143, 144, 145, 146, 147, and 148 may be a preset experimental value capable of optimizing the image quality of the organic light-emitting display apparatus. Neighboring gamma sets may be connected linearly to each other using interpolation. FIG. 5 shows eight gamma sets 141, 142, 143, 144, 145, 146, 147, and 148. However, the number of the gamma sets 141, 142, 143, 144, 145, 146, 147, and 148 which are stored in the gamma set storage 140 is not limited thereto and may vary.

The gamma set selector 120 may select one of the gamma sets 141, 142, 143, 144, 145, 146, 147, and 148 whose the maximum luminance, that is, the luminance corresponding to gamma data corresponding to the 225 gray level, matches the externally input luminance data.

The dimming data storage 160 may store a first dimming data 161 to an eighth dimming data 162 respectively corresponding to the first gamma set 141 to the eighth gamma set 148.

Each of the dimming data 161, 162, 163, 164, 165, 166, 167, and 168 may refer to an off duty ratio indicating a ratio of a time duration for which the organic light-emitting diode is turned off within one frame.

The dimming data 161, 162, 163, 164, 165, 166, 167, and 168 may be the same as or different from each other. As described above, the luminance of the organic light-emitting apparatus may be determined based on the gamma set 141, 142, 143, 144, 145, 146, 147, or 148 and the dimming data 161, 162, 163, 164, 165, 166, 167, or 168, or may be determined based on the same dimming data 161, 162, 163, 164, 165, 166, 167, and 168. Thus, when the dimming data 161, 162, 163, 164, 165, 166, 167, and 168 are the same as each other, and the gamma sets 141, 142, 143, 144, 145, 146, 147, and 148 are different from each other, the display apparatus may output different luminance levels.

That is, the luminance level at which the organic light-emitting display apparatus outputs an image may be determined based on the gamma set 141, 142, 143, 144, 145, 146, 147, or 148 and the corresponding dimming data 161, 162, 163, 164, 165, 166, 167, or 168.

As described above, the luminance level at which the organic light-emitting display apparatus outputs an image is determined based on the gamma set 141, 142, 143, 144, 145, 146, 147, or 148 and the corresponding dimming data 161, 162, 163, 164, 165, 166, 167, or 168. Thus, when the dimming data 161, 162, 163, 164, 165, 166, 167, and 168 are the same as each other, and the gamma sets 141, 142, 143, 144, 145, 146, 147, and 148 are different from each other, the display apparatus may output different luminance levels.

The neighboring dimming data 161, 162, 163, 164, 165, 166, 167, and 168 may be linearly connected to each other using an interpolation method. FIG. 5 shows 8 dimming data 161, 162, 163, 164, 165, 166, 167, and 168. The dimming data 161, 162, 163, 164, 165, 166, 167, and 168 respectively correspond to the gamma sets 141, 142, 143, 144, 145, 146, 147, and 148. Thus, the number of dimming data 161, 162, 163, 164, 165, 166, 167, and 168 may vary according to the number of gamma sets 141, 142, 143, 144, 145, 146, 147, and 148.

Figure 6:
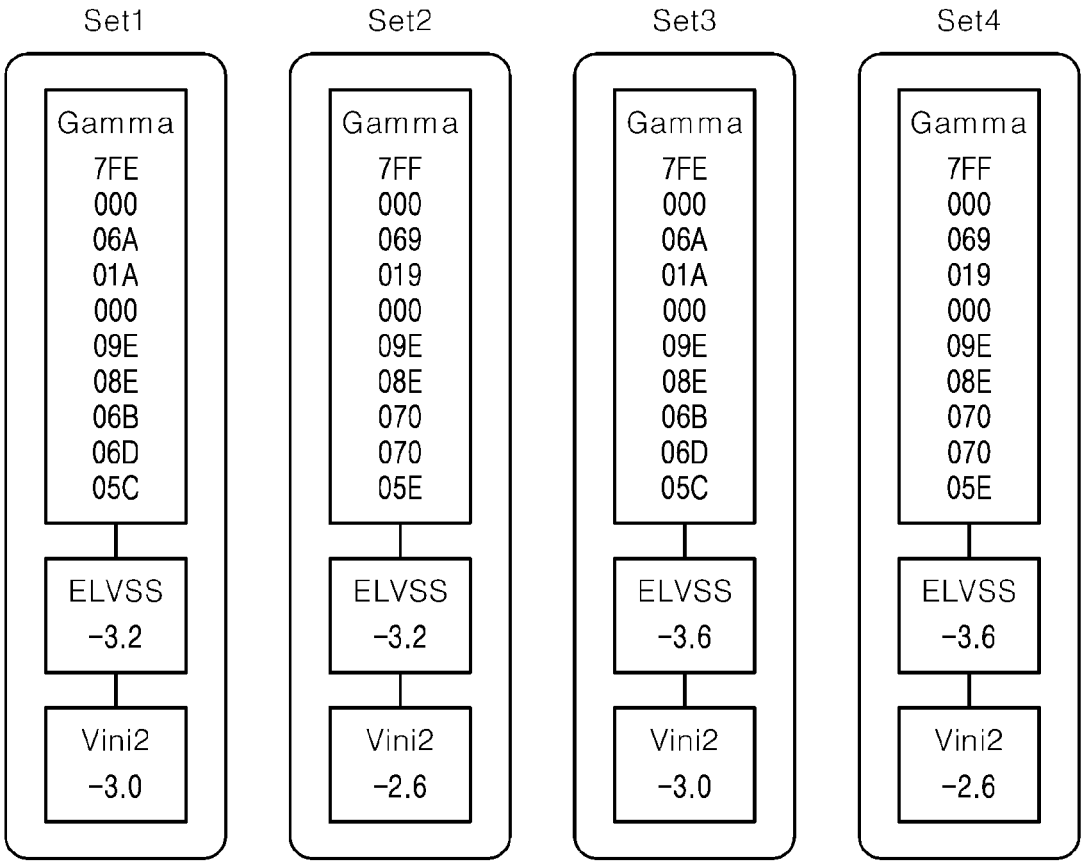
FIG. 6 illustrates a gamma set, a low voltage and an initialization voltage set in a lookup table of a data driver according to an embodiment of the present disclosure.

FIG. 6 illustrates the gamma set, the low voltage and the initialization voltage set in the lookup table of the data driver according to an embodiment of the present disclosure.

Referring to FIG. 6, the lookup table 110 of the data driver 40 according to an embodiment of the present disclosure stores therein, for example, a first gamma set Gamma Set 1 to a fourth gamma set Gamma Set 4.

In the first gamma set Gamma Set 1, each gamma voltage is recorded at each of addresses such as 7FE, 000, 06A, 01A, 000, 09E, 08E, 06B, 06D, 05C, etc. The low voltage ELVSS is set to −3.2V, and the initialization voltage Vini2 is set to −3.0V.

In the second gamma set Gamma Set 2, each gamma voltage is recorded at each of addresses such as 7FF, 000, 069, 019, 000, 09E, 08E, 070, 070, 05E. The low voltage ELVSS is set to −3.2V. The initialization voltage Vini2 is set to −2.6V.

In the third gamma set Gamma Set 3, each gamma voltage is recorded at each of addresses of 7FE, 000, 06A, 01A, 000, 09E, 08E, 06B, 06D, 05C, etc. The low voltage ELVSS is set to −3.6V. The initialization voltage Vini2 is set to −3.0V.

In the fourth gamma set Gamma Set 4, each gamma voltage is recorded at each of addresses such as 7FF, 000, 069, 019, 000, 09E, 08E, 070, 070, 05E. The low voltage ELVSS is set to −3.6V. The initialization voltage Vini2 is set to −2.6V.

Therefore, when the third gamma set Gamma Set 3 is selected by the luminance controller 10, and the data driver 40 receives the third gamma set Gamma Set 3 from the luminance controller 10, the data driver 40 may select the low power voltage ELVSS −3.6V and the initialization voltage Vini2 −3.0V corresponding to the third gamma set Gamma Set 3 based on the lookup table 110 and provide the low power voltage ELVSS −3.6V and the initialization voltage Vini2 −3.0V to the display panel 20 through the data lines DLI to DLm.

Figure 7:
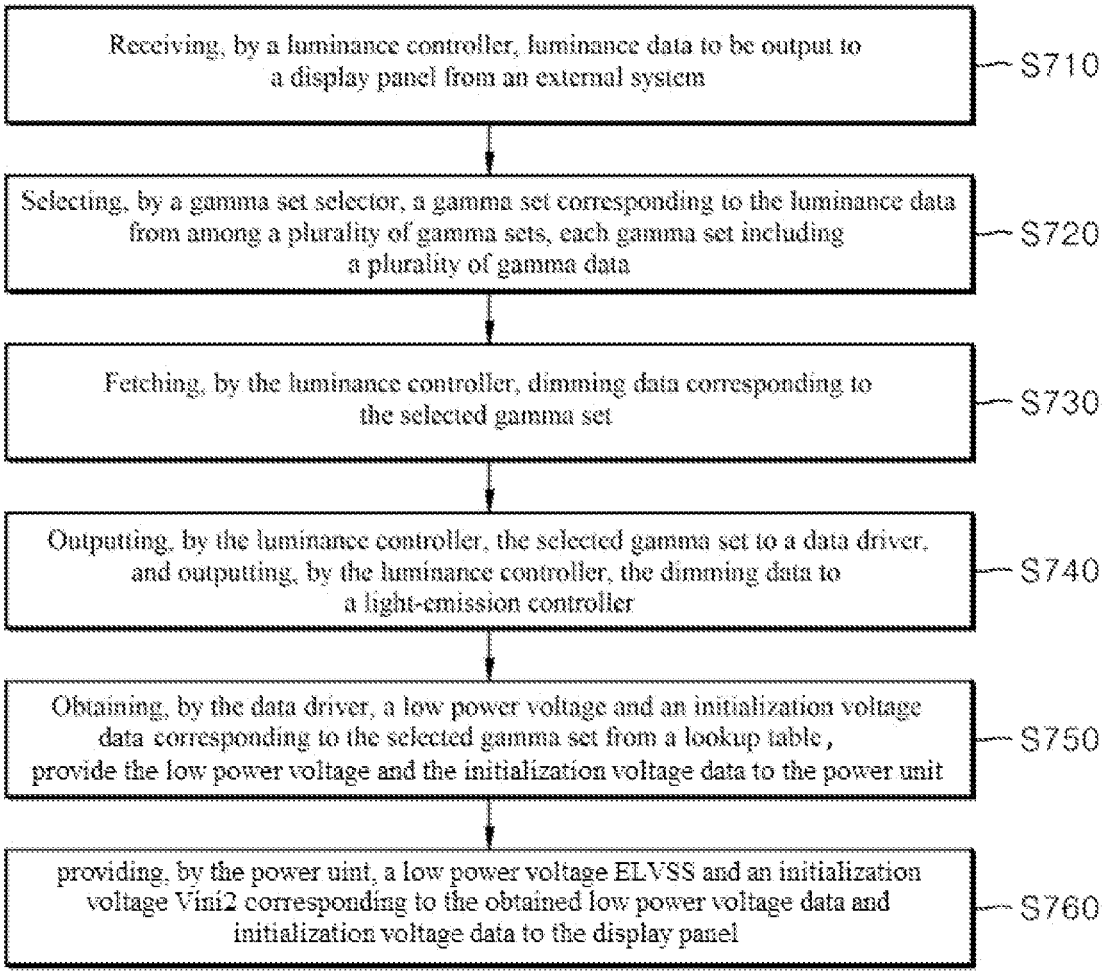
FIG. 7 is an operation flow chart for describing a method for selection of a gamma voltage of a display apparatus according to an embodiment of the present disclosure.

FIG. 7 is an operation flow chart for describing a method for selection of a gamma voltage of a display apparatus according to an embodiment of the present disclosure.

Referring to FIG. 7, the luminance controller 10 of the display apparatus 100 for selection of the gamma voltage according to an embodiment of the present disclosure receives the luminance data that is to be output to the display panel 20 from an external system S710.

In this connection, the luminance data input from the external system may refer to data representing the maximum luminance at which the organic light-emitting display panel displays an image, and may be within a range that the organic light-emitting display panel may output. For example, for a display panel capable of outputting up to 300 nit, the luminance data may be selected from a range of 0 to 300 nit.

Subsequently, the gamma set selector 120 of the luminance controller 10 selects a gamma set corresponding to the luminance data from among a plurality of gamma sets, each set including a plurality of gamma data S720.

For example, the gamma set selector 120 may select the second gamma set Gamma Set 2 corresponding to the luminance data from among the plurality of gamma sets Gamma Set 1 to 4 as shown in FIG. 6.

Further, the gamma set whose maximum luminance is consistent with the luminance data input from the external system may be selected among the gamma sets stored in a second lookup table. That is, a plurality of gamma sets may be included in the second lookup table. Each gamma set may include the plurality of gamma data corresponding to the gray levels. In this connection, the second lookup table refers to a storage separate from the lookup table 110 provided in the data driver 40 in FIG. 2, and may be located close to the luminance controller 10 and stores therein dimming data corresponding to each gamma set.

The lookup table should be interpreted as a storage device in which a plurality of gamma sets are stored. Thus, a name of the lookup table is not limited to the lookup table.

Subsequently, the luminance controller 10 fetches the dimming data corresponding to the selected gamma set S730.

For example, the luminance controller 10 fetches, from the second lookup table, second dimming data Dimming data #2 corresponding to the selected second gamma set Gamma Set 2 as shown in FIG. 5.

In this connection, the luminance controller 10 may fetch the dimming data by selecting the dimming data corresponding to the selected gamma set from the second lookup table. That is, the dimming data corresponding to the plurality of gamma sets may be further included in the second lookup table. In this way, when the luminance data to be realized is input to the organic light-emitting display panel, the gamma set and the dimming data corresponding to a target luminance level may be selected from the second lookup table.

Then, the luminance controller 10 outputs the selected gamma set to the data driver 40, and outputs the corresponding dimming data to the light-emission controller 50 S740.

In this connection, the data driver 40 may generate data signal DATA based on the gamma set. The light-emission controller 50 may generate the light-emission control signal EMIT based on the dimming data. Based on the light-emission control signal EMIT, the organic light-emitting diode EL may perform a dimming operation. In one embodiment, the dimming operation may be a global dimming operation, which may be done over an entire area of the display panel. In another embodiment, the dimming operation may be a local dimming operation which may be performed individually over partial areas of the display panel.

Then, the data driver 40 obtains the low power voltage data and the initialization voltage data corresponding to the selected gamma set from the lookup table 110, and provide the low power voltage data and the initialization voltage data to the power part 60 S750.

In this connection, the lookup table 110 stores therein one low power voltage data and one initialization voltage data corresponding to each of the plurality of gamma sets, as shown in FIG. 6.

Then, the power part 60 provides a low power voltage ELVSS and initialization voltage Vini2 corresponding to the low power voltage data and the initialization voltage data provided from the data driver 40 to the display panel 20 S760.

For example, when the second gamma set (Gamma Set 2) is selected by the gamma set selector 120, the power part 60 provides a low power voltage ELVSS of −3.2V and an initialization voltage Vini2 of −2.6V to the display panel 20. Thus, each pixel operates according to the low power voltage ELVSS and the initialization voltage Vini2 applied from the power part 60, such that the organic light emitting diode EL emits light.

In this connection, the power part 60 generates power required for operation of the pixel array of the display panel 100 and the data driver 40 using a DC-DC converter. The DC-DC converter may include a charge pump, a regulator, a buck converter, a boost converter, etc. The power part 60 adjusts a DC input voltage from a host system (not shown) to generates direct current power such as a gamma reference voltage, a gate on voltage VGL, a gate off voltage VGH, a high power voltage ELVDD, a low power voltage ELVSS, an initialization voltage Vini2, etc. The gamma reference voltage is supplied to a gamma compensation voltage generator. The gate on voltage VGL and the gate off voltage VGH are supplied to a level shifter and the data driver 40.

Therefore, pixel power such as the high power voltage ELVDD, the low power voltage ELVSS, and the initialization voltage Vini2 are commonly supplied to the pixels PX.

In one example, although not shown in the drawing, the luminance controller 10 according to an embodiment of the present disclosure may include a gamma compensation voltage generator that divides the gamma reference voltage GVDD using a voltage dividing circuit and outputs gray level-based gamma compensation voltages to the data driver 40. The gamma compensation voltage generator may include a common gamma generator and first to third gamma generators.

The common gamma generator generates first and second reference voltages VREG1 and VREG2. The first reference voltage VREG1 refers to a high potential reference voltage divided into a gamma compensation voltage V0 to V255 representing a first luminance range L1. The first luminance range L1 refers to the luminance of an input image as realized on a screen AA in a normal driving mode. The first and second reference voltages VREG1 and VREG2 output from the common gamma generator are commonly supplied to the first to third gamma generators.

The second reference voltage VREG2 refers to a high potential reference voltage to generate a gamma compensation voltage V0 to V256 representing a second luminance range L2 in a boost mode. The second reference voltage VREG2 is set to a voltage higher than the first reference voltage VREG1.

The boost mode may refer to a driving mode in which the luminance should be locally increased on the screen AA. A fingerprint sensing mode may be set as one of the boost modes. When using an optical fingerprint sensor, and when the luminance of the pixels PX which are used as a light source is increased to a higher luminance than that in the normal driving mode, an amount of light received by an image sensor may be increased, thereby improving a sensing sensitivity of a fingerprint pattern.

When a finger is touched on the screen of the display panel 20, the display apparatus may generate a boost mode signal indicating the fingerprint sensing mode in response to an output signal from a touch sensor or a pressure sensor. When the boost mode signal is input from a host system to the data driver, the data driver 40 improves a pixel luminance of a fingerprint sensing area SA to a luminance set in the boost mode and then turns on the fingerprint sensing area SA at a high luminance level.

The first luminance range L1 may be a luminance range of 2n gray levels that may be expressed by n bit pixel data where n is a positive integer of 8 or greater. The second luminance range L2 may be a luminance range of 2n+1 gray levels that may be expressed by n+1 bit pixel data. The highest luminance in the second luminance range L2 is higher than that in the first luminance range L1. In the second luminance range L2, the display apparatus presents a locally bright image in the screen AA or in a high luminance mode.

In the boost mode, the fingerprint sensing area SA may be set to a specific area within the screen AA. In the boost mode, pixels PX in the fingerprint sensing area SA may emit light at a luminance level in the second luminance range L2. In order to improve an amount of light which is emitted from the optical fingerprint sensor and is received by the image sensor, the boost mode is activated when a fingerprint sensing event occurs. Thus, the luminance in the fingerprint sensing area SA may be controlled to be higher than that in other pixels PX outside the fingerprint sensing area SA. When the fingerprint sensing event occurs, other pixels PX outside the fingerprint sensing area SA may display an input image at a luminance level in the first luminance range L1.

In the normal driving mode, the luminance of the pixels PX in the entire screen AA including the fingerprint sensing area SA is controlled to the first luminance range L1. Therefore, in the normal driving mode, the highest luminance of all of the pixels PX in the screen AA is the highest luminance in the first luminance range L1.

The boost mode may be activated to improve the luminance of the screen AA in bright outdoor environments, product display modes, etc. In this case, in a mobile apparatus or a wearable apparatus to which an embodiment of the present disclosure is applied, the boost mode may be activated when it is determined depending on an output from an illumination sensor that use environment is bright or when a sample image is displayed in an exhibition hall. Therefore, according to an embodiment of the present disclosure, the luminance of the pixels PX may be enhanced to a level higher than that in the normal driving mode, when it is necessary to increase the luminance locally on the screen AA or in a bright environment or the product display mode.

The OLED used as the light-emitting element of the organic light-emitting display apparatus may have different light-emitting efficiencies based on different colors. Thus, adjusting a color-based gamma compensation voltage in an optical compensation stage before shipping of the display apparatus may allow the luminance and color coordinates of display panels to be uniform. The first to third gamma generators are separated from each other based on the colors, and thus respectively generate the optimal color-based gamma compensation voltages. Each of the first to third gamma generators divides the first reference voltage VREG1 to output 2n gamma compensation voltages V0 to V255, and divides first reference voltage VREG1 or the second reference voltage VREG2 to output 2n+1 gamma compensation voltages V0 to V256.

The gamma compensation voltage V0 to V256 output from the first gamma generator may act as a gray level-based voltage of the data voltage to be supplied to a R sub-pixel. The gamma compensation voltage V0 to V256 output from the second gamma generator may act as a gray level-based voltage of the data voltage to be supplied to a G sub-pixel. The gamma compensation voltage V0 to V256 output from the third gamma generator may act as a gray level-based voltage of the data voltage to be supplied to a B sub-pixel.

As described above, when the display apparatus 100 for selection of the gamma power according to an embodiment of the present disclosure controls the luminance of the display panel based on the luminance data input from an external system, the display apparatus may select the gamma set corresponding to the luminance data and the dimming data corresponding to the gamma set and thus may perform precise dimming operation. Therefore, the display apparatus may fix or change the dimming data in a high luminance area or a low luminance area. Thus, the display quality of the organic light-emitting display apparatus may be improved, compared to a conventional scheme that sequentially increases the dimming data as a pixel area changes from a high luminance area to a low luminance area.

As described above, an embodiment of the present disclosure may provide the display apparatus which includes the data driver which sets the low voltage ELVSS and the initialization voltage Vini2 corresponding to each gamma set and stores the same into the lookup table.

Further, an embodiment of the present disclosure may provide the display apparatus which includes the data driver which selects the gamma set according to luminance data of image data, and selects the low voltage ELVSS and the initialization voltage Vini2 corresponding to the selected gamma set based on the lookup table, and provides the selected low voltage ELVSS and initialization voltage Vini2 to the display panel.

Further, an embodiment of the present disclosure may provide the method for selection of the gamma power of the display apparatus that selects a gamma set according to luminance data of image data received from an external component, and selects a low voltage ELVSS and an initialization voltage Vini2 corresponding to the selected gamma set based on the lookup table, and provides the selected low voltage ELVSS and initialization voltage Vini2 to the display panel.

Although the embodiments of the present disclosure have been described in more detail with reference to the accompanying drawings, the present disclosure is not necessarily limited to these embodiments. The present disclosure may be implemented in various modified manners within the scope not departing from the technical idea of the present disclosure. Accordingly, the embodiments disclosed in the present disclosure are not intended to limit the technical idea of the present disclosure, but to describe the present disclosure. The scope of the technical idea of the present disclosure is not limited by the embodiments. Therefore, it should be understood that the embodiments as described above are illustrative and non-limiting in all respects. The scope of protection of the present disclosure should be interpreted by the claims, and all technical ideas within the scope of the present disclosure should be interpreted as being included in the scope of the present disclosure.

What is claimed is:

1. A display apparatus, comprising:

a display panel having a plurality of gate lines and a plurality of data lines intersecting each other, and having a plurality of pixels, wherein each pixel is disposed at each of intersections between the plurality of gate lines and the plurality of data lines, wherein each pixel includes an organic light-emitting diode;

a scan driver configured to apply a scan signal to the plurality of gate lines;

a data driver configured to apply a data signal to the plurality of data lines;

a light-emission controller configured to apply a light-emission control signal to the plurality of pixels;

a power part configured to supply a high power voltage, a low power voltage, and an initialization voltage to the pixels;

a timing controller configured to control the scan driver, the data driver, the light-emission controller, and the power part; and a luminance controller configured to:

provide one gamma set among a plurality of gamma sets to the data driver, wherein each gamma set includes a plurality of gamma data; and provide dimming data corresponding to the selected gamma set to the light-emission controller, wherein upon receiving the selected one gamma set from the luminance controller, the data driver provides a low power voltage data and an initialization voltage data in correspondence with the selected one gamma set to the power part, and the power part provides a low power voltage ELVSS and an initialization voltage Vini2 corresponding to the low power voltage data and the initialization voltage data provided from the data driver to the plurality of pixels.

2. The display apparatus of claim 1, wherein the data driver includes a look-up table that stores one low power voltage data and one initialization voltage data in correspondence with one gamma set.

3. The display apparatus of claim 1, wherein the luminance controller includes:

a gamma set selector configured to receive luminance data to be output to the display panel from an external system, and determining the selected gamma set corresponding to the luminance data;

a gamma set storage configured to store therein the plurality of gamma sets; and a dimming data storage configured to store therein a plurality of dimming data respectively corresponding to the plurality of gamma sets.

4. The display apparatus of claim 3, wherein the luminance data represents a maximum luminance output from the display panel, wherein the selected gamma set is a gamma set having a maximum luminance matching the luminance data among the plurality of gamma sets.

5. The display apparatus of claim 3, wherein a dimming operation of the display panel is performed based on the dimming data, wherein the dimming data indicates an off duty ratio to control a light-emitting time duration of the organic light-emitting diode.

6. The display apparatus of claim 5, wherein the dimming operation is a global dimming operation and is performed on an entire area of the display panel.

7. The display apparatus of claim 5, wherein the dimming operation is a local dimming operation and is performed individually on partial areas of the display panel.

8. The display apparatus of claim 1, wherein the luminance controller is disposed in the data driver or is connected to the data driver.

9. A method for selecting a gamma power of a display apparatus, the method comprising:

(a) receiving, by a luminance controller, luminance data to be output to a display panel from an external system;

(b) selecting, by a gamma set selector, a gamma set corresponding to the luminance data from among a plurality of gamma sets, each gamma set including a plurality of gamma data;

(c) fetching, by the luminance controller, dimming data corresponding to the selected gamma set;

(d) outputting, by the luminance controller, the selected gamma set to a data driver, and outputting, by the luminance controller, the dimming data to a light-emission controller;

(e) obtaining, by the data driver, a low power voltage data and an initialization voltage data corresponding to the selected gamma set from a lookup table, and provides the obtained the low power voltage data and the initialization voltage data to the power part; and (f) providing, by the power part, a low power voltage ELVSS and an initialization voltage Vini2 corresponding to the obtained low power voltage data and initialization voltage data to the display panel.

10. The method of claim 9, wherein the look-up table stores one low power voltage and one initialization voltage in correspondence with one gamma set.

11. The method of claim 9, wherein the luminance data represents a maximum luminance output from the display panel, wherein the selected gamma set is a gamma set having a maximum luminance matching the luminance data among the plurality of gamma sets, wherein the dimming data indicates an off duty ratio to control a light-emitting time duration of the organic light-emitting diode, and wherein a dimming operation of the display panel is performed based on the dimming data.

* * * * *